United States Patent [19]

Harrison

[11] Patent Number: 4,520,051

[45] Date of Patent: May 28, 1985

[54] METHOD OF WATERPROOFING A POROUS WALL

[75] Inventor: George W. Harrison, Houston, Tex.

[73] Assignee: Team, Inc., Houston, Tex.

[21] Appl. No.: 567,650

[22] Filed: Jan. 3, 1984

[51] Int. Cl.[3] ..... B05D 5/00

[52] U.S. Cl. ..... 427/387; 427/140; 427/393.6; 427/421; 264/DIG. 80; 52/515; 52/516; 52/517

[58] Field of Search ..... 427/331, 387, 393.6, 427/421, 445, 140; 52/515, 516, 517; 264/DIG. 80

[56] References Cited

U.S. PATENT DOCUMENTS 1,796,269 3/1931 Rose ..... 264/DIG. 80

4,273,813 6/1981 Meddaugh ..... 52/515

4,395,457 7/1983 Wyner ..... 52/515

FOREIGN PATENT DOCUMENTS 1177662 1/1970 United Kingdom ..... 52/515

*Primary Examiner*—Shrive P. Beck

*Attorney, Agent, or Firm*—Guy E. Matthews

[57] ABSTRACT

A method of waterproofing a porous wall of a subterranean vault as provided by propelling a moisture activated, room temperature curable, pourable, self-leveling dimethylpolysillxane or dialkylpolysillxane which are generally referred to as silicone or TV rubber onto the side of the wall and thereafter subjected to moisturizing conditions to activate the resins to form a water impervious flexible barrier adjacent the wall.

2 Claims, 2 Drawing Figures

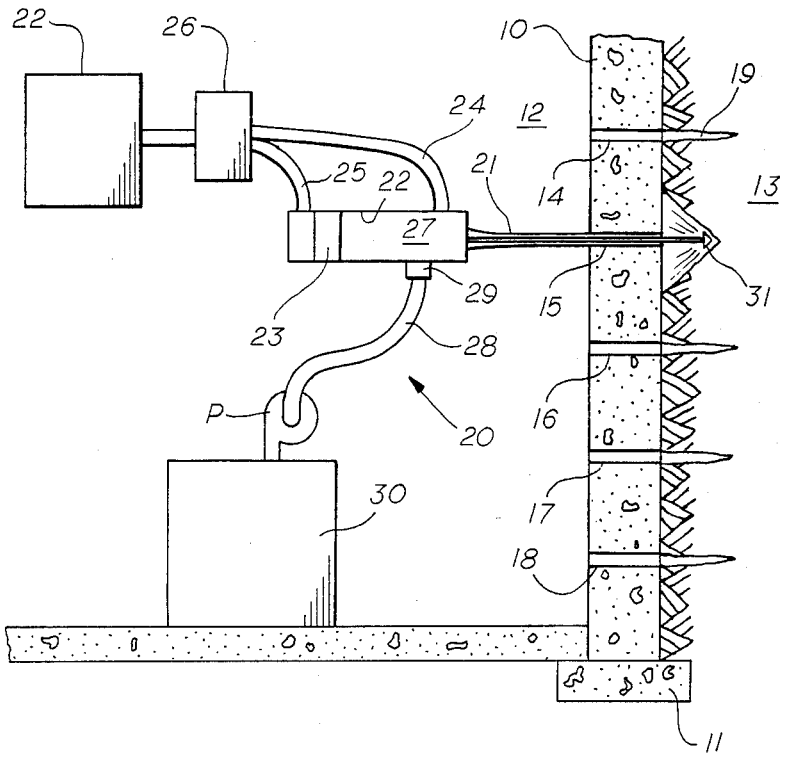
fig.1
fig.2
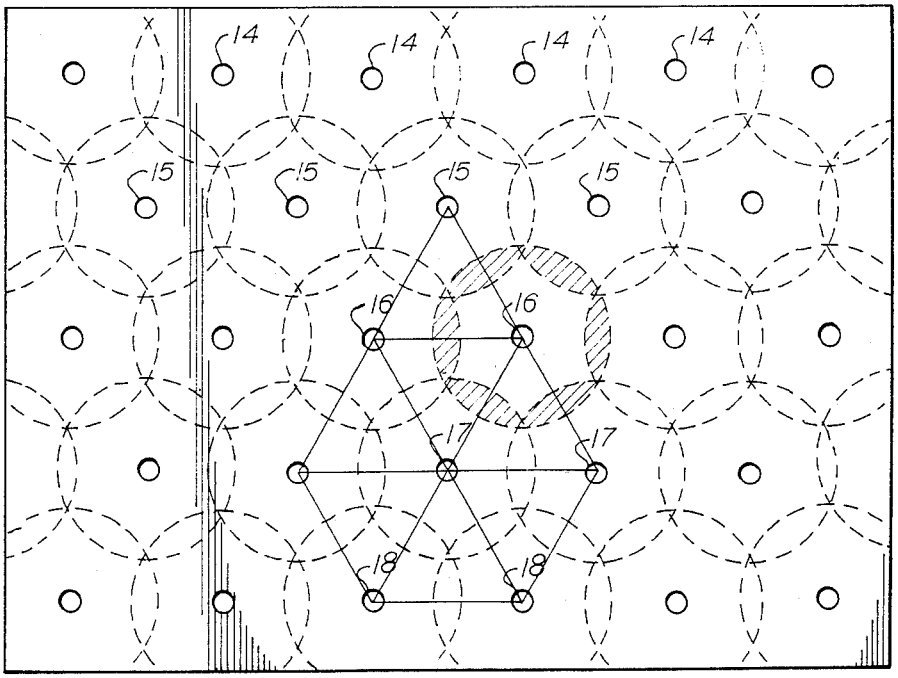

METHOD OF WATERPROOFING A POROUS WALL

BACKGROUND OF THE INVENTION

1. Field of the Invention

This invention relates to methods of waterproofing porous concrete or masonry subterranean walls and foundations; and more particularly, pertains to methods for creating a waterproof barrier on the exterior or soil side of a subterranean, concrete or masonry foundation or wall.

2. Brief Description of the Prior Art

Concrete and masonry foundations such as found in basements of buildings or in underground vaults (such as contain utility power station gathering in distribution systems) are porous, and water seeps through steadily, unless halted by a waterproof barrier inside or outside the wall.

Water seepage into an underground basement or vault often results from settling of a foundation. The foundation footing rests on the soil and supports the entire weight of the superstructure. Some parts of the footing may be weaker than others, and the result is an uneven distribution of the weight, often stressing the wall such that it cracks, creating an entrance place for moisture.

Poor workmanship in the construction of a wall or foundation is a cause of water entry. Sometimes the grade of mortar used in the laying of a concrete block foundation is inadequate or the mortar does not make a solid bond between the blocks, and water from the ground outside penetrates. Alternatively, when the foundation is solid concrete, it can have been poured in layers with an imperfect bond made between the layers.

Seepage may be the result of heavy ground moisture. Areas in which there are clay subsoils, high water tables, or other poor drainage conditions can result in a tremendous force being exerted by water in the ground that will drive the water through pores of the wall. The conventional cure for water seepage in subterranean walls and/or foundations has been to coat the inside or basement surface of the wall with a waterproofing compound applied to unpainted masonry or concrete. Another cure has been to pour a latex solution into the ground directly above where a crack in the wall starts. The latex solution makes its way down, following microscopic channels created by the water that found its way into the basement, and finally flows into the crack itself. As it flows it sets up; fully setup it fills both channels and cracks until they are closed completely. When the ground to be treated is sealed off by a hard surfacer, such as a concrete walk or drive or other finish, a hole is drilled through the surfacer as close to the wall as possible and the latex solution is poured through the holes to find a crack in the wall, or a hole is drilled through the basement wall below ground level and a tube is inserted into the hole long enough to reach the soil outside, with the latex patcher solution being poured through the tube to the outside wall. The hole in the wall is then filled with a patcher.

Finally, a less convenient but longer lasting cure heretofore has been to completely evacuate the ground around the outside walls of the basement or vault so that the wall can be waterproofed all the way down to the footing. In this, a waterproofing mastic is applied to the wall, followed by several coats of asphalt paint, then asphalt paper, and then finally another coat of asphalt paint, after which the evacuated area is back filled and sloped away from the wall.

The foregoing methods are not wholly satisfactory in waterproofing subterranean walls. Waterproofing compound applied to interior walls eventually disintegrates as it looses adhesion under pressure of water seepage from the outside. Latex solutions applied to the outside utilizing gravity forces often do not set up well in a wet soil and are largely a hit or miss solution. Application of an asphalt coating to the outside requires excavation of the soil, and even after applied, is subject to dissolution by hydrocarbons as might spill from a tank truck adjacent the wall. Asphalts are also subject to shrinkage retraction upon drying, and with alternating wet and dry exposure can suffer cracks that undo the coating.

SUMMARY OF THE INVENTION

It is an object of this invention to provide a water barrier to a porous wall which will have its barrier function aided by water.

It is an object of this invention to provide a water barrier for a porous wall which is elastomeric and flexible for withstanding minor movements in the wall structure and still continue to provide a water barrier.

In accordance with the invention, these objects are satisfied and short comings of the prior art are overcome by spraying a coating of a moisture activated, room temperature curable, dimethylpolysiloxane or dialkylpolysiloxane which are generally referred to as silicone or TV rubber of pourable, self-leveling grade through porous earth to the exterior surface of a subterranean wall, and subjecting that coating to moisturizing conditions so that the resin is cured to form a water impervious flexible barrier adherent to the wall.

DESCRIPTION OF THE DRAWING

FIG. 1 is a schematic illustration in side elevational and partial vertical sectional view illustrating a method for applying a water impervious barrier in accordance with a preferred embodiment of the invention.

FIG. 2 is a diagrammatic view of a portion of face of the wall 10 illustrated in FIG. 1.

DESCRIPTION OF THE PREFERRED EMBODIMENT

Referring to FIG. 1, a poured concrete wall 10 of footing 11 separates a subterranean vault or basement 12 from earth 13. As illustrated by FIGS. 1 & 2, a suitable pattern of hole series 14, 15, 16, 17 and 18 is drilled along the extent of the wall laterally and vertically below the ground level. The drilling is continued into the earth, as indicated at earth bore 19. As may be seen by reference to FIG. 2, the holes of the series 14, 15, 16, 17 and 18 are patterned as the points of equilateral triangles, such that circles whose centers are the holes will overlap one another to define a surface free of voids or holidays.

Referring to FIG. 1, a high pressure burst sprayer indicated generally be reference numeral 20 is illustrated situated in vault 12. While the spray pattern hereinbelow described is illustrated in the drawing as being 360° it is to be understood that other angles of spray patterns may be used. The high pressure sprayer 20 includes a wand tube 21 connected to a cylinder 22 containing a piston or ram 23 within a chamber 27 accessed by dry gas lines 24, 25 that are gated by a switch 26 to a source 22 of high pressure dry gas. Wand 21 terminates in a retrodirected nozzel 31 configured to jet fluid in a circular discharge pattern centered axially with and toward wand 21. Chamber 27 at the end of it proximate the wand is also accessed by an inlet tube 28 controlled by a valve 29. Inlet tube 28 leads to a reservoir 30 of a pourable, self-leveling, moisture activated, room temperature curable silicone or TV rubber.

In operation to perform the method of the invention, the wand 20 is inserted through one of the holes in the series 14, 15, 16, 17 and 18 (as shown in FIG. 1, a hole in series 15) and on into an earth bore hole 19 in the adjacent earth 13 so the nozzel is disposed a distance in the earth 13 from wall 10 suitable to provide a circular resin retrospray pattern of diameter greater than the distance separating that hole from any hole next adjacent to it. To apply the resin, a valve (not illustrated) controlling the entrance to the tubular passageway of want 21 is switched shut and gate 26 is engaged to direct air into chamber 27 while exhausting air therefrom by means of line 25, resulting in retraction of the ram 23. Gate 26 is then rotated to exhaust line 24 to atmosphere, valve 29 is opened, and the pump P is engaged to pump the resin from reservoir 30 through line 28 into chamber 27 until it is filled. The valve controlling the entrance to the wand passageway is then opened and valve 29 is closed. Next, gate 26 is moved to suddenly connect high pressure line 25 to the drive side of ram 23, exploding high pressure against the ram, driving the ram immediately to the end of its travel within cylinder 73 and burst expelling the resin in chamber 27 out chamber 27 through wand tube 21 and, by the direction of retrospray nozzel 31, through the pores of earth 13 onto the earth side of wall 10 in a generally circular pattern. The resin is burst discharged at a velocity in excess of Mach 4 and in a volume of 250 ml per impulse. It is to be understood that the impluse is not at a set rate. At this velocity, the flowable, self-leveling grade silicone or TV rubber penetrates the pores of the soil conically toward the exterior face of wall 10 and describes a generally circular coating of resin whose center is the approximate axis of the hole through which the wand is inserted. The process is then repeated for each hole, burst discharging the flowable silicone or TV rubber through the soil onto the earth's side of the wall through each of the holes of the pattern according to a chosen sequence until a complete coating of the resin is applied to the wall.

A resin suitable for this application is General Electric portable/self-leveling standard grade RTV 112 and RTV 118 silicone rubber adhesive sealants, available from General Electric Company, Silicone Products Division, RTV Products Department, Waterford, N.Y. and described in General Electric Product Brochures CDS-1582D. Also suitable is Dow Corning Silicone Elastomer Silastic 734 RTV, available from Dow Corning Corporation, Midland, Mich. "Silastic" and "Dow Corning" are registered trademarks of Dow Corning Corporation. These flowable resins cure to form a tough, durable resilient silicone rubber on exposure to atmospheric moisture at room temperature, and will flow out or self-level on a surface, filling surface discontinuities and recesses, providing a uniform coating which when cured will have a Shore A hardness of about 25, a tensile strength of about 350 pounds per square inch, and an elongation of about 350%.

The resin projected onto the earth side of the wall 10 is subjected to moisturizing conditions to activate cure of the resin, from the moisture on the wall onto which the resin coating is sprayed and the moisture in the facing earth. Upon bonding to the wall after cure, the elastic properties of the silicone rubber barrier accommodate dislocations in the wall brought on by soil movement and the like. Because of the impervious properties of the coating, hydrostatic water pressure from high water tables and other door drainage conditions force the coating against the wall, instead of away from the wall as with the case in coatings applied on the interior wall surface of the vault 12.

Following application of the resin coating to the earth side of the wall 10, all holes drilled in the wall are plugged, preferably with a nonporous material.

While a single embodiment of the invention has been described herein, many variations thereof may be made without the parting of the spirit of the invention. Accordingly, it is intended that the scope of the invention be limited only by the claims which follow.

I claim:

1. A method of waterproofing a porous wall of a subterranean vault, wherein one side of the said wall is adjacent porous earth, which comprises the steps of:

(a) propelling a moisture activated, room temperature curable porable, self-leveling dimethylpolysiloxane or dialkylpolysiloxane which are generally referred to as silicone or TV rubber through said earth onto said side of said wall, and (b) subjecting said resin to moisturizing conditions whereby said resin is activated to cure and form a water impervious flexible barrier adherent to said wall.

2. A method of waterproofing a porous wall of a subterranean vault, wherein one side of the said wall is adjacent porous earth, which comprises the steps of:

(a) drilling a pattern of holes through the wall below the ground level of said earth and into the earth on the other side of the wall from the chamber to obtain earth bores in the same patterns;

(b) inserting a tubular wand through one of said holes into one of said earth bores, said wand ending in a nozzel configured to retrodirect fluid radially and outwardly from and backwardly along the axis of said wand, said wand being operatively connected to a high pressure burst impulse sprayer;

(c) activating said impulse sprayer to burse discharge a moisture activated, room temperature curable, pourable, self-leveling dimethylpolysiloxane or dialkylpolysiloxane which are generally referred to as silicone or TV rubber radially, outwardly, and backwardly through said earth onto said side of the wall adjacent the earth;

(d) repeating steps (b) and (c) for all the holes in the said pattern, said pattern being chosen such that the performance of steps (b), (c) and (d) will result in a complete resin coating of the side of the wall adjacent the earth;

(e) subjecting said coating to moisturizing conditions whereby said resin is activated to cure thereby to form a water impervious flexible barrier adherent to said wall; and (f) plugging said holes drilled in said wall.

* * * * *